United States Patent [19]

Yono et al.

[11] 4,416,120

[45] Nov. 22, 1983

[54] SPRAY ASSEMBLY FOR REFRIGERATED DISPLAY CASES

[76] Inventors: Munim Yono, 41292 Marks Dr., Novi, Mich. 48050; Russell L. Dolin, 190 Southfield, Ecorse, Mich. 48229

[21] Appl. No.: 405,931

[22] Filed: Aug. 6, 1982

[51] Int. Cl.[3] ..... A47F 3/04

[52] U.S. Cl. ..... 62/231; 62/249; 62/303; 134/57 R; 134/100; 134/200; 312/116; 312/313

[58] Field of Search ..... 62/303, 231, 249, 246; 134/57 R, 198, 200, 100; 312/116, 313

[56] References Cited

U.S. PATENT DOCUMENTS

| | | | |
|---|---|---|---|
| 516,005 | 3/1894 | Geer | 312/313 X |
| 803,485 | 10/1905 | Higgins | 312/313 |
| 1,908,968 | 5/1933 | Forman | 62/231 |
| 2,474,452 | 6/1949 | Amyot | 62/303 X |
| 3,320,964 | 5/1967 | Tripp | 62/303 X |
| 3,610,417 | 10/1971 | DeLoach | 134/198 X |
| 3,638,448 | 2/1972 | Raymer | 62/303 X |
| 4,058,383 | 11/1977 | Peterson | 62/303 |
| 4,315,414 | 2/1982 | Ibrahim | 62/303 X |
| 4,368,757 | 1/1983 | Finger | 134/100 X |

*Primary Examiner*—William E. Tapolcai

*Attorney, Agent, or Firm*—Cullen, Sloman, Cantor, Grauer, Scott & Rutherford

[57] ABSTRACT

A spray assembly for a refrigerated display case has inclined bottom plates defining a first chamber below the bottom plates and a spray chamber above the bottom plates. Pressurized water is delivered into the first chamber through a water pipe having a normally closed control valve connected thereto for pressure delivery of water to a spray support pipe which extends from the first chamber into the spray chamber centrally thereof. A spray pipe is mounted on and communicates with the spray support pipe and has a plurality of opposed rows of water outlets for delivering a pattern of pressurized streams of water onto interior surfaces of the case and the undersurfaces of the grates and tubing of the cooling system for washing them down and for successive disposal through a drain pipe depending from the bottom plates. The present spray assembly is adapted for a series of laterally related display cases wherein the pressurized water pipe extends into the bases of the respective cases and with corresponding normally closed control valves within each first chamber connected to the water pipe. A timer is adapted to progressively open the valves in the respective first chambers for progressively washing down the interiors of the display cases.

7 Claims, 4 Drawing Figures

SPRAY ASSEMBLY FOR REFRIGERATED DISPLAY CASES

BACKGROUND OF THE INVENTION

Heretofore in the use of display cases wherein meat and fowl are supported within a refrigerated chamber upon pans mounted upon suitable inclined wire grates, fluids from the food including blood from time to time drip down from the pans through the grates and onto interior surface portions of the cases. If not washed frequently the accumulation of food particles and other substances upon the interior of the case, the grates and tubing of the cooling system would provide contamination, health and odor problems and reduce cooling efficiency. Thus, it is necessary from time to time, sometimes twice a day to manually wash down the corresponding interiors of the display cases.

Often there is an accumulation of fluids, food particles and liquids upon the interior of the case and upon the grates which support the food pans, and upon the tubing of the cooling system. Considerable time and manual labor are required for the intermittent washing down of the interior of such refrigerated food display cases, particularly in the case of meat and fowl.

PRIOR ART

It has been recognized that a water supply and spray may be provided for the interior of such cases for the purpose of intermittently washing down interior surfaces of such cases. Examples of prior art efforts to accomplish the washing of such cases are found in one or more of the following United States patents:

| NUMBER | NAME | DATE |
|---|---|---|
| 2,474,452 | A. Amyot | June 28, 1949 |
| 3,320,964 | L. H. Tripp | May 23, 1967 |
| 3,528,259 | S. Saal | September 15, 1970 |
| 3,638,448 | Doyle Raymer | February 1, 1972 |
| 3,733,840 | Donald C. Pearl | May 22, 1973 |
| 3,777,988 | Ralph F. Thomson | December 11, 1973 |
| 4,058,383 | LeRoy Peterson | November 15, 1977 |
| 4,315,414 | F. Abrahim | February 16, 1982 |

SUMMARY OF THE INVENTION

An important feature of the present invention is to provide a spray assembly for a refrigerated display case wherein the case includes upon its interior, downwardly inclined bottom plates terminating in a drain pipe for connection to a sewer and underlying and supporting said plates, a hollow base upon a floor surface defining a first chamber with the drain extending through the first chamber and into a sewer pipe.

A further feature includes a support mechanism provided upon the interior of the case for mounting and supporting therein a refrigerating system including a series of connected tubing connected to an exterior compressor condenser assembly. A series of laterally aligned downwardly inclined wire grates are mounted and supported upon the interior of the case above the cooling system adapted for supporting meat and fowl or other food products. A pressurized spray assembly is positioned within a spray chamber below the grates and above the bottom plates, including an upright water supply pipe which extends from the first chamber and into the spray chamber centrally thereof and which mounts an elongated spray pipe extending substantially the length of the case.

A further feature incorporates a water pipe connected to a pressurized source of water which is projected through the bases of adjacent display cases and wherein within each base there is positioned a normally closed automatic valve controlling the progressive flow of pressurized water through the water support pipes and spray pipes in the respective cases for use in conjunction with a preset timer which is electrically connected progressively to the respective automatic valves so that progressively the valves are opened for the successive operation of the spray assembly within the respective adjacent cases.

A further feature incorporates the use of the relief valve normally spring biased to an open drain position and connected to the spray support pipe and spray pipe within each case providing for automatic draining of said pipes, the relief valve being responsive to pressure fluid delivered to the water pipe for automatic closing of the relief valve and for the operation of the spray pipes for delivering a spray of fluids upon the interior of the case and over the grates supported therein.

A further feature contemplates an improved method of mounting and supporting the refrigerating system within the cases together with electrical connections between a timer and the refrigerating systems so that during washing of the interior of the case, the refrigeration system is deactivated.

These and other features and objects will be seen from the following Specification and claims in conjunction with the appended drawings.

THE DRAWINGS

It will be understood that the drawings illustrate merely a preferred embodiment of the invention, and that other embodiments are contemplated within the scope of the claims hereafter set forth.

DETAILED DESCRIPTION OF AN EMBODIMENT OF THE INVENTION

Figure 2:
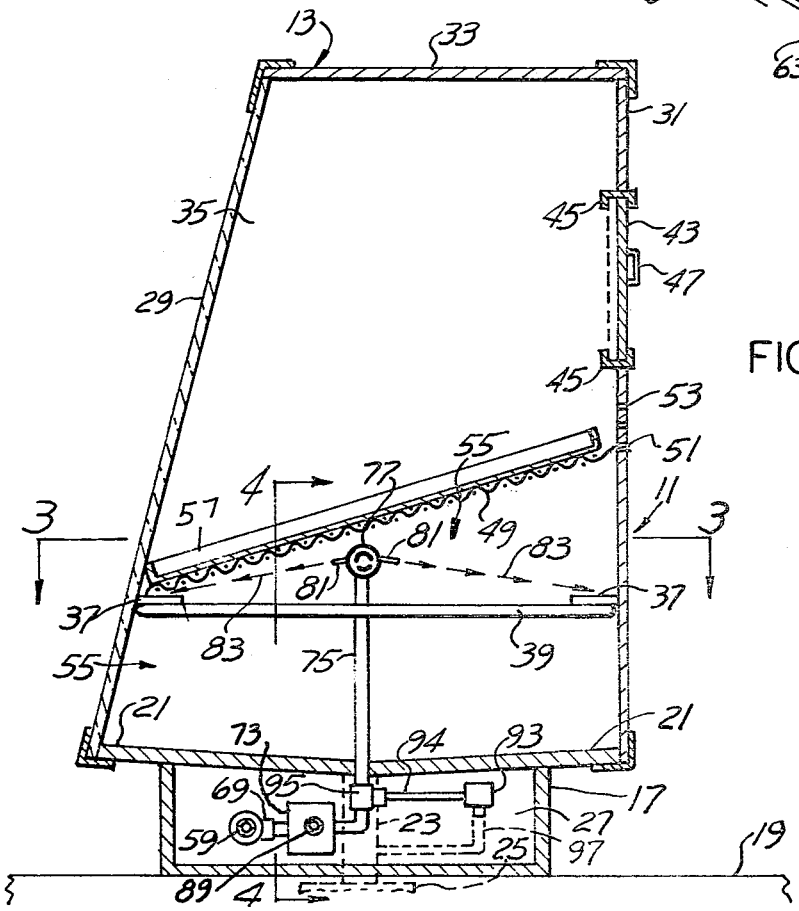
FIG. 2 is a vertical section through the complete display case shown in FIG. 1.
Figure 4:
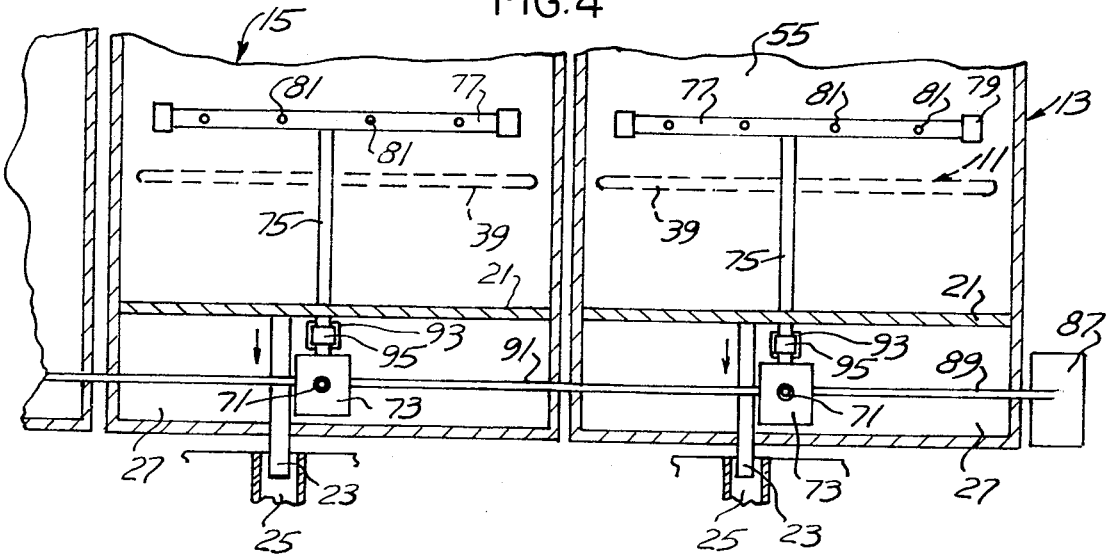
FIG. 4 is a vertical section taken in the direction of arrows 4—4 of FIG. 2.

The present spray assembly for refrigerated display cases is generally indicated at 11, FIGS. 2 and 4 and includes a plurality of display cases 13 and 15 normally arranged adjacent each other and end to end in a portion of a store, for example. Each display case includes a hollow base 17, FIG. 2 mounted upon floor 19.

Figure 1:
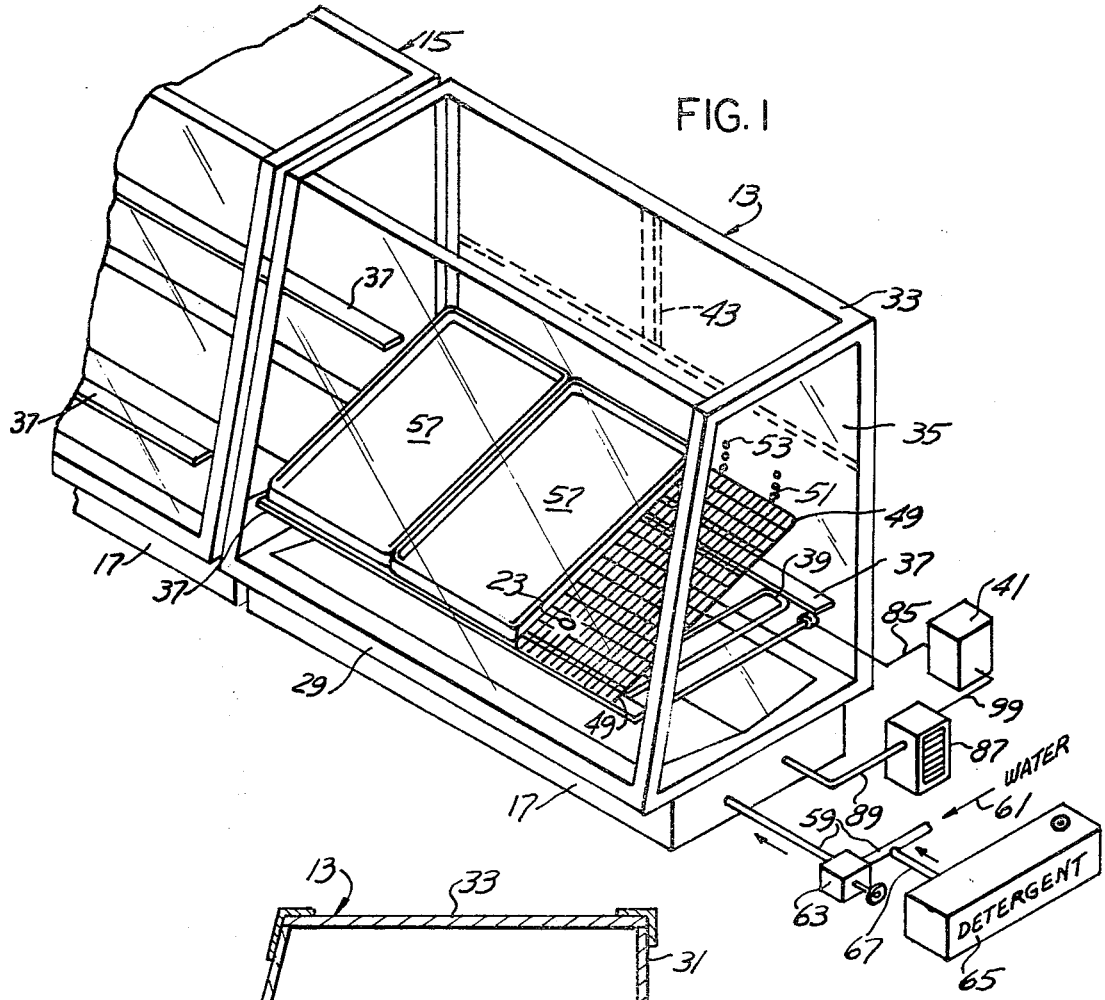
FIG. 1 is a fragmentary perspective view of a pair of adjacent refrigerated food display cases incorporating the present spray assembly.

Each case includes a pair of converging downwardly inclined bottom plates 21 at their lower most point of terminating in a drain pipe 23, FIG. 2 which extends through first chamber 27 within said base and outwardly thereof and into the inlet of a sewer pipe 25, fragmentarily shown. Each of the cases 13 and 15 include inclined front wall 29 and rear wall 31. At least the front walls and top walls are of glass for visual access to the interior of the respective cases. Each case has a pair of upright end walls 35. Parallel spaced front and rear ledges 37 extend between the end walls 35 and at their ends are suitably secured to said end walls as shown in FIGS. 1 and 2.

Conventional cooling system includes one or a plurality of continuous cooling coils 39 which extend between, span and are supported upon the undersurface of the ledges 37 above the bottom plates 21. Said refrigerating system includes a compressor condensor assembly 41 connected to the cooling coils by the conduit 85 as schematically shown in FIG. 1.

Upon the rear wall 31 of said case are a pair of upright sliding doors 43 mounted upon suitable guide support channels 45 having a suitable handle 47 on such sliding doors as fragmentarily shown in FIG. 2. Mounted within each case are a plurality of wire grates 49 which are normally inclined forwardly and downwardly at an angle of approximately 30 degrees for illustration.

The forward edges of the respective wire grates are supportably positioned upon the front ledge 37 adjacent front wall 29, FIG. 2. The corresponding rear edges of the respective wire grates are mounted for vertical adjustment upon the case rear wall 31.

For this purpose there is provided upon the rear edges of each of the wire grates 49 a pair of grate support hooks 51 which are selectively positioned within corresponding vertically spaced apertures 53 upon rear wall 31. This provides a means by which the angularity of the wire grate may be determined and at the same time supporting the rear edges of the corresponding grates 49. These are normally laterally aligned such as shown in FIG. 1 and upon which are supported a plurality of laterally related display pans 57 which normally hold raw meat or poultry or other food products refrigerated within the case and for display therein.

The corresponding aligned wire grates 49 define with the interior walls of the refrigerated display case and the bottom plates 21 a spray chamber 55 above the bottom plates 21 and within which are disposed the cooling system 39 and grates 39.

Figure 3:
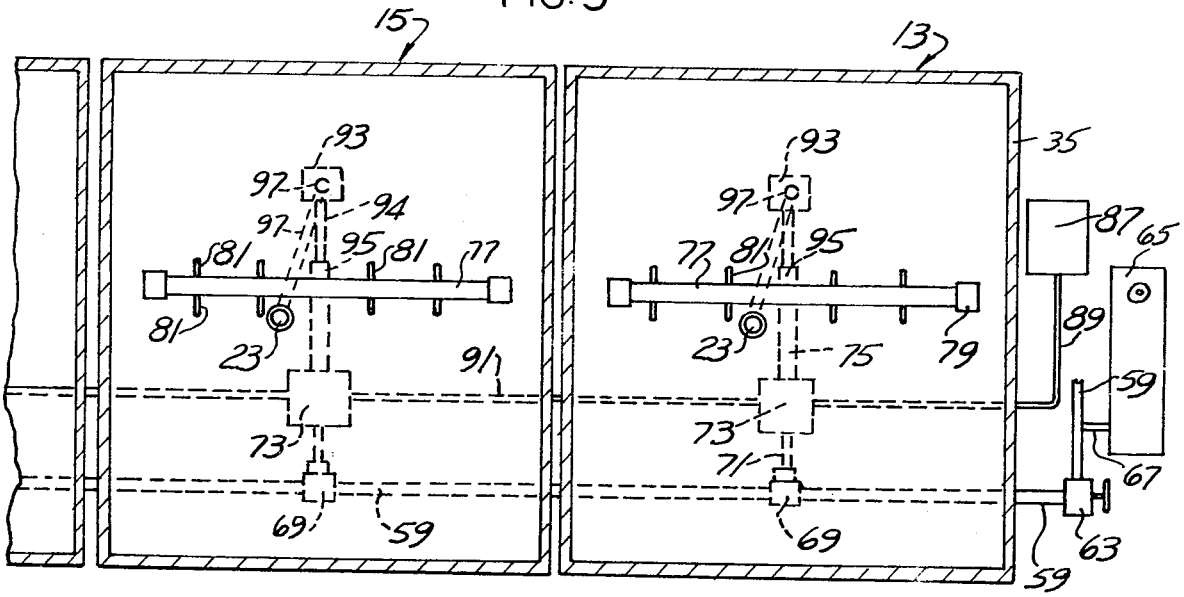
FIG. 3 is a fragmentary plan view taken in the direction of arrows 3—3 of FIG. 2 including a pair of adjacent display cases such as shown in FIG. 1.

Water pipe 59, fragmentarily shown in FIG. 1, as well as in FIGS. 2, 3 and 4 is connected to a source of pressurized city water as at 61, and projects into and through the corresponding bases 17 of the individual cases, such as shown in FIGS. 3 and 4, being nested within the first chamber 27 within the corresponding bases 17.

Detergent reservoir 65 is shown in FIG. 1 having an outlet pipe 67 connected to the water pipe 59 such that the flow of water therethrough under the control of the hand valve 63 will cause measured amounts of detergent to enter the water as it is passing through the water pipe 59 and into the respective bases of the cases 13 and 15.

Within each case and within the base 17 therefore and the chamber 27 therein there is provided upon the water pipe 59 the T-coupling 69 to which is connected the water feed pipe 71 which extends to the normally closed automatic valve 73. The outlet of the corresponding automatic valves 73 has connected thereto the upright spray support pipe 75 which extends from the first chamber 27 up into and centrally of the spray chamber 55.

Horizontally disposed sprayer pipe 77 having end caps 79 thereon is mounted intermediate its ends such as centrally thereof upon the spray support pipe 75 in communication therewith, and is arranged centrally of the respective case and extending along the length thereof.

Each of the respective sprayer pipes 77 have along their length upon opposite sides opposed rows of spray outlets 81 including nozzles as shown in FIGS. 2 and 3 for delivering a spray pattern 83 of pressurized water from the spray pipe 77 into the interior of the case and particularly the spray chamber 55.

When the respective spray pipes 77 are activated by the automatic opening of the corresponding valve 73, the pattern of pressurized water with added detergent or other chemical is delivered to the interior of the case for impingement upon the under surface of the respective wire grates 49 the tubing 39 of the cooling system as well as the interior surfaces of the corresponding walls 29 and 31, the case end walls 35 as well as the bottom plates 21 for washing down and draining through the drain pipe 23 for delivery to the sewer 25 fragmentarily shown in FIGS. 2 and 4.

In order to provide for control over the amount of water at any one time draining through into the sewer 25 to prevent flooding, there is incorporated into the present spray assembly a suitable preset timer 87, FIG. 1, having an electrical conduit 89 which extends into and through the respective bases 13 and for independent connection to the corresponding normally closed control valves 73. Depending upon the setting of the timer, such as for 15 minutes, 30 minutes or an hour, the respective automatic valves will be progressively energized one at a time, and the respective case interiors are washed down progressively.

While a single conduit is shown at 89 extending from the timer, the wiring includes the additional electrical conduits 91 FIG. 4 so that only one automatic valve is energized at a time depending upon the setting of the timer 87.

For each of the respective upright water support pipes 75 there is provided within each of the first chambers 27 within the bases 17 a corresponding normally open spring biased relief valve 93 connected by pipe 94 to the coupling 95, FIG. 2. Since the relief valves 93 are responsive to water pressure when the corresponding automatic valve is activated by the timer, the water pressure within the spray support pipe 75 will automatically close the relief valve against its spring bias such that the drain from the relief valve 77 is closed and the full water pressure is delivered through pipe 75 and into the corresponding spray pipe 77.

Just as soon as the automatic valve is closed through the action of the timer 87, the pressure is relieved from the pipe 75 with the result that the relief valve 93 automatically opens. This provides a means by which any water which had accumulated within the pipes 75 and 77 will be automatically drained through the conduit 97 to the sewer inlet 25, FIG. 2. This means that after the washing operation, the refrigerating system is again energized, there will be no water accumulated within the pipes 75 and 77 which could freeze.

It is contemplated that by virtue of a suitable electrical lead 99 between timer 87 and the control assembly for the refrigerating system shown at 41, at the time that the timer is operative to energize the respective valves 73 progressively, the refrigerating system will be deactivated. It has been found that with coolant flowing through the cooling system, it is difficult to remove from the corresponding surface areas and including the cooling pipes, any accumulation of fluid or other fluids including blood upon the interior of the case. It is found furthermore that during the period of washing down of the interior of the case it is advantageous that the cooling system be entirely deactivated for that limited period. By the present construction and by the presetting of the timer 87 so as to progressively activate the corresponding spray assemblies within the respective cases, there is a progressive means provided by which the cases can be automatically washed once or twice each 24 hours, or as often as is desired, with the water draining down from the respective cases successively and through the corresponding drains and into the sewer pipe 25 without overloading the sewer.

It is for this reason that the timer is employed so that the respective normally closed water pressure control valves 73 are activated progressively, one at a time.

Having described our invention, reference should now be had to the following claims.

We claim:

1. A spray assembly for refrigerated display cases, each case having front, rear, top and end walls and converging downwardly inclined bottom plates having a depending drain pipe;

a hollow base upon a floor underlying and supporting said bottom plates and case including a first chamber, said drain extending through said base and adapted for connection to a sewer pipe;

front and rear ledges in said case interconnecting and supported upon said end walls and spaced above said bottom plates;

a refrigerating system including tubing underlying connected to and spanning said ledges;

a series of laterally aligned downwardly inclined wire grates at their front edges mounted upon said front ledge adjacent said front wall and at their rear edges adjustably mounted upon said rear wall above said rear ledge;

said grates with adjacent front, rear and end walls and bottom plates defining a spray chamber;

said grates adapted to supportably mount thereon a series of laterally aligned food display pans;

a water pipe connectable to a source of pressurized water extending into and along the bases of said cases within said first chambers;

a normally closed automatic valve within each first chamber below said bottom plates respectively connected to said water pipe;

an upright spray support pipe connected to each valve;

a horizontal closed end sprayer pipe intermediate its ends mounted upon and in communication with said spray support pipe and extending along the length of said case centrally thereof;

there being opposed pairs of rows of spray outlets extending from opposite sides of said spray pipe outletting into said spray chamber for washing and rinsing said grates, tubing and interior surfaces of said case and for automatic withdrawal through said drain pipe;

said automatic valves being adapted to be energized successively for the progressive washing of said cases.

2. In the spray assembly of claim 1, an adjustable preset timer exterior of said cases having an electrical conduit extending into said first chambers and separately connected progressively to each of said automatic valves for progressively energizing said valves for a preset time interval.

3. In the spray assembly of claim 1, said refrigerating system having a normally closed switch;

and a lead wire between said timer and refrigerator switch to deenergize said cooling system during washing of said cases.

4. In the spray assembly of claim 1, a normally open pressure relief valve within said first chamber having an outlet connected to said sewer pipe and an inlet connected to said spray support pipe for automatically draining said support pipe and sprayer pipe when said automatic valve is closed;

opening of said automatic valve under the control of said timer adapted to close said pressure release valve during the washing cycle.

5. In the spray assembly of claim 1, a detergent reservoir having an outlet connected to said water pipe.

6. In the spray assembly of claim 1, the adjustable mounting of the rear edges of said grates including a plurality of vertically spaced rows of apertures in said rear wall;

and a pair of grate support hooks at the rear end of each grate adjustably positioned within corresponding rear wall apertures.

7. In the spray assembly of claim 1, the opposed rows of spray outlets including oppositely directed spray nozzles arranged in rows for directing a water spray pattern under pressure to the undersurface of such grates to the tubing and to the interior walls of said case.

* * * * *